US006179433B1

(12) United States Patent
Shiao

(10) Patent No.: US 6,179,433 B1
(45) Date of Patent: Jan. 30, 2001

(54) DRIVING TOOL WITH ILLUMINATING CAPABILITY

(76) Inventor: Hsuan-Sen Shiao, No. 15-1, Lane 369, Min-Chaun Rd., Taichung Hsien (TW)

( * ) Notice: Under 35 U.S.C. 154(b), the term of this patent shall be extended for 0 days.

(21) Appl. No.: 09/354,566

(22) Filed: Jul. 16, 1999

(51) Int. Cl.[7] ..... B25B 23/18
(52) U.S. Cl. ..... 362/120; 362/206
(58) Field of Search ..... 362/109, 119, 362/120, 206, 234

(56) References Cited

U.S. PATENT DOCUMENTS 5,772,308 * 6/1998 Lin ..... 362/119
6,022,121 * 2/2000 Lin ..... 362/119

* cited by examiner

*Primary Examiner*—Stephen Husar
(74) *Attorney, Agent, or Firm*—Pillsbury, Madison & Sutro LLP

(57) ABSTRACT

A driving tool includes a handle having a tubular surrounding wall defining a torch receiving compartment. A front end wall is disposed at a front end of the surrounding wall, and has a drive shaft extending outwardly of the torch receiving compartment. The front end wall is formed with a lamp receiving hole offset from the drive shaft and in communication with the compartment. A torch is received removably in the torch receiving compartment, and includes a tubular torch housing with front and rear end portions. The front end portion confines a battery receiving space to receive a battery cell therein. A switch member is mounted in the rear end portion of the torch housing, and has a first switch contact to establish electrical contact with a first battery terminal of the battery cell. A lamp extends into the lamp receiving hole, and has a first lamp terminal that extends into the front end portion of the torch housing, and a second lamp terminal electrically connected to a second switch contact of the switch member. A conductive lamp contact member is disposed in the front end portion, and is connected to the first lamp terminal of the lamp and to a second battery terminal of the battery cell. A rear cap is mounted removably on a rear end of the surrounding wall for retaining the torch in the torch receiving compartment.

7 Claims, 5 Drawing Sheets

DRIVING TOOL WITH ILLUMINATING CAPABILITY

FIELD OF THE INVENTION

The invention relates to a driving tool, more particularly to a driving tool with an illuminating capability.

BACKGROUND OF THE INVENTION

Referring to FIG. 1, a conventional driving tool 10 is shown to include an elongated hollow handle 11 made of an insulator material, a torch unit, and a rear cap 16 also made from an insulator material.

As illustrated, the handle 11 has a tubular surrounding wall with front and rear ends 111, 112 and extending in a longitudinal direction to confine a receiving compartment 12 therein, and a front mounting wall 113 provided at the front end 111. The front mounting wall 113 has a drive shaft 17 that extends therefrom outwardly of the receiving compartment 12 in the longitudinal direction. The front mounting wall 113 is further formed with two lamp receiving holes 121 which are offset from the drive shaft 17 and which are in communication with the receiving compartment 12.

The torch unit includes two lamps 132 received in the lamp receiving holes 121 respectively, a conductive lamp contact piece 131 disposed transversely in the receiving compartment 12, two battery cells 14 disposed in the receiving compartment 12, and a switch member 15 disposed in the receiving compartment 12 proximate to the battery cells 14. The lamps 132 and the battery cells 14 are connected in series via the lamp contact piece 131. The switch member 15 are connected to and bias the battery cells 14 toward the lamp contact piece 131 when the rear cap 16 is mounted removably on the rear end 112 of the surrounding wall, and has a press button 151 that projects outwardly of the rear cap 16. When pressure is applied on the press button 151, a closed electrical circuit will be formed to activate the lamps 132.

Some of the disadvantages of the aforesaid driving tool 10 are as follows:

(a) It is time-consuming to bore the lamp receiving holes 121 through the front mounting wall 113.

(b) The torch unit cannot be separated from the handle 11, thereby restricting the utility of the conventional driving tool 10 in view of the need to purchase an extra torch.

(c) The handle 11 is bulky, because it is designed to accommodate two battery cells 14 that are disposed side-by-side.

SUMMARY OF THE INVENTION

The main object of this invention is to provide a driving tool with an illuminating capability, which is clear of the aforesaid disadvantages that result from the use of the conventional driving tool.

Accordingly, the driving tool of the present invention includes an elongated hollow handle, a torch, and a rear cap. The handle has a tubular surrounding wall with front and rear ends. The surrounding wall extends in a longitudinal direction, and confines a torch receiving compartment therein. A front end wall is disposed at the front end of the surrounding wall. The front end wall has a drive shaft that extends therefrom outwardly of the torch receiving compartment in the longitudinal direction, and is formed with a lamp receiving hole that extends in the longitudinal direction and that is offset from the drive shaft. The torch is received removably in the torch receiving compartment via the rear end of the surrounding wall of the handle. The torch includes a tubular torch housing, a switch member, a lamp, and a conductive lamp contact member. The tubular torch housing has front and rear end portions. The front end portion confines a battery receiving space that is adapted to receive a battery cell therein. The switch member is mounted in the rear end portion of the torch housing, and has a first switch contact adapted to establish electrical contact with a first battery terminal of the battery cell when the battery cell is received in the battery receiving space, and a second switch contact. The lamp extends into the lamp receiving hole, and has a first lamp terminal that extends into the front end portion of the torch housing, and a second lamp terminal electrically insulated from the first lamp terminal and electrically connected to the second switch contact. The conductive lamp contact member is disposed in the front end portion of the torch housing, and is connected electrically to the first lamp terminal of the lamp. The lamp contact member is adapted to establish electrical contact with a second battery terminal of the battery cell when the battery cell is received in the battery receiving space. The rear cap is mounted removably on the rear end of the surrounding wall of the handle for retaining removably the torch in the torch receiving compartment.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
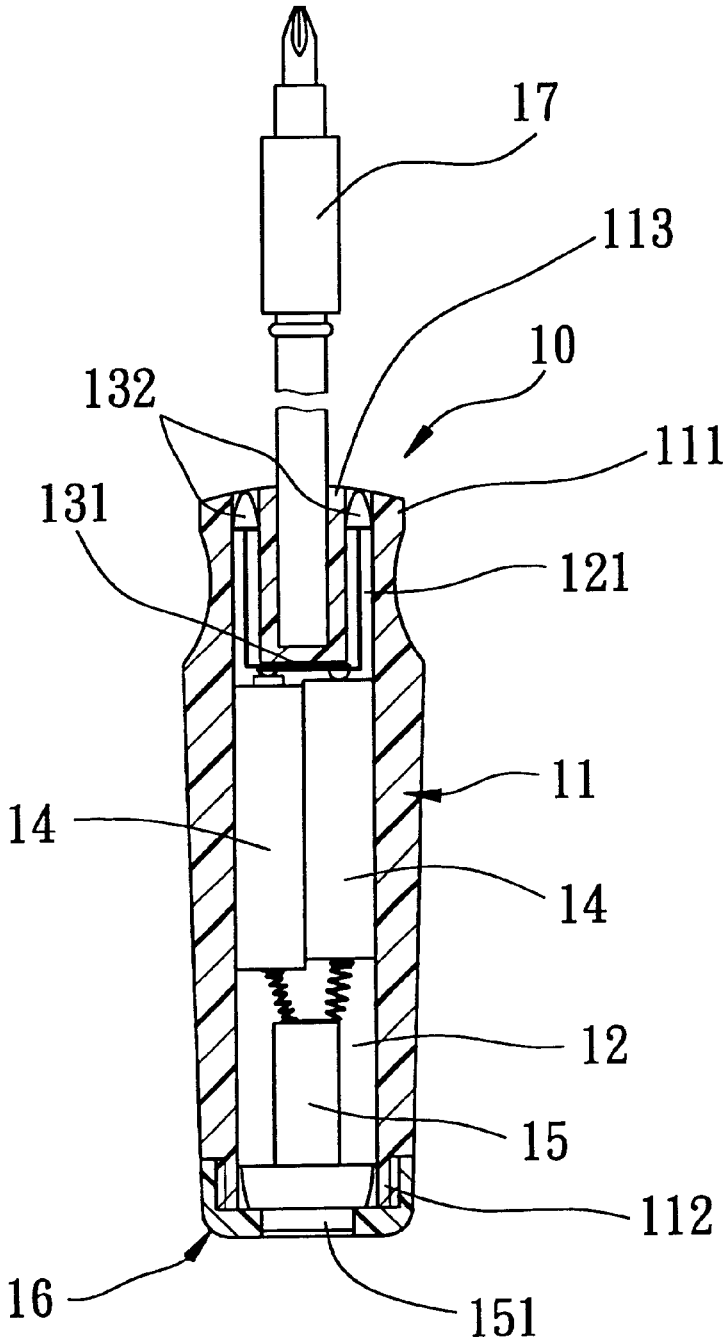
FIG. 1 PRIOR ART
FIG. 1 is a fragmentary sectional view of a conventional driving tool.
Figure 2:
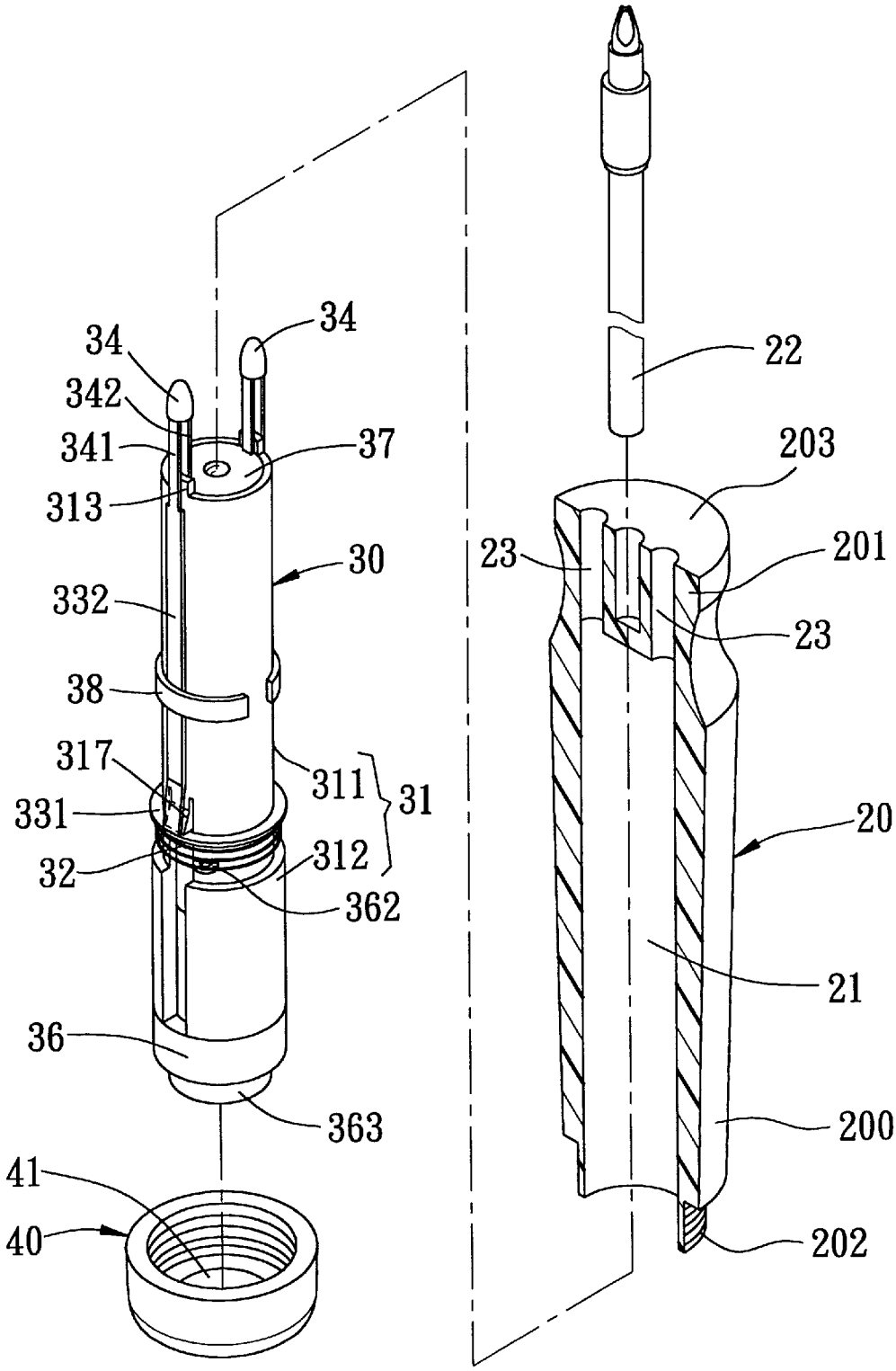
FIG. 2 is an exploded partly sectional view of the preferred embodiment of a driving tool of the present invention.
Figure 3:
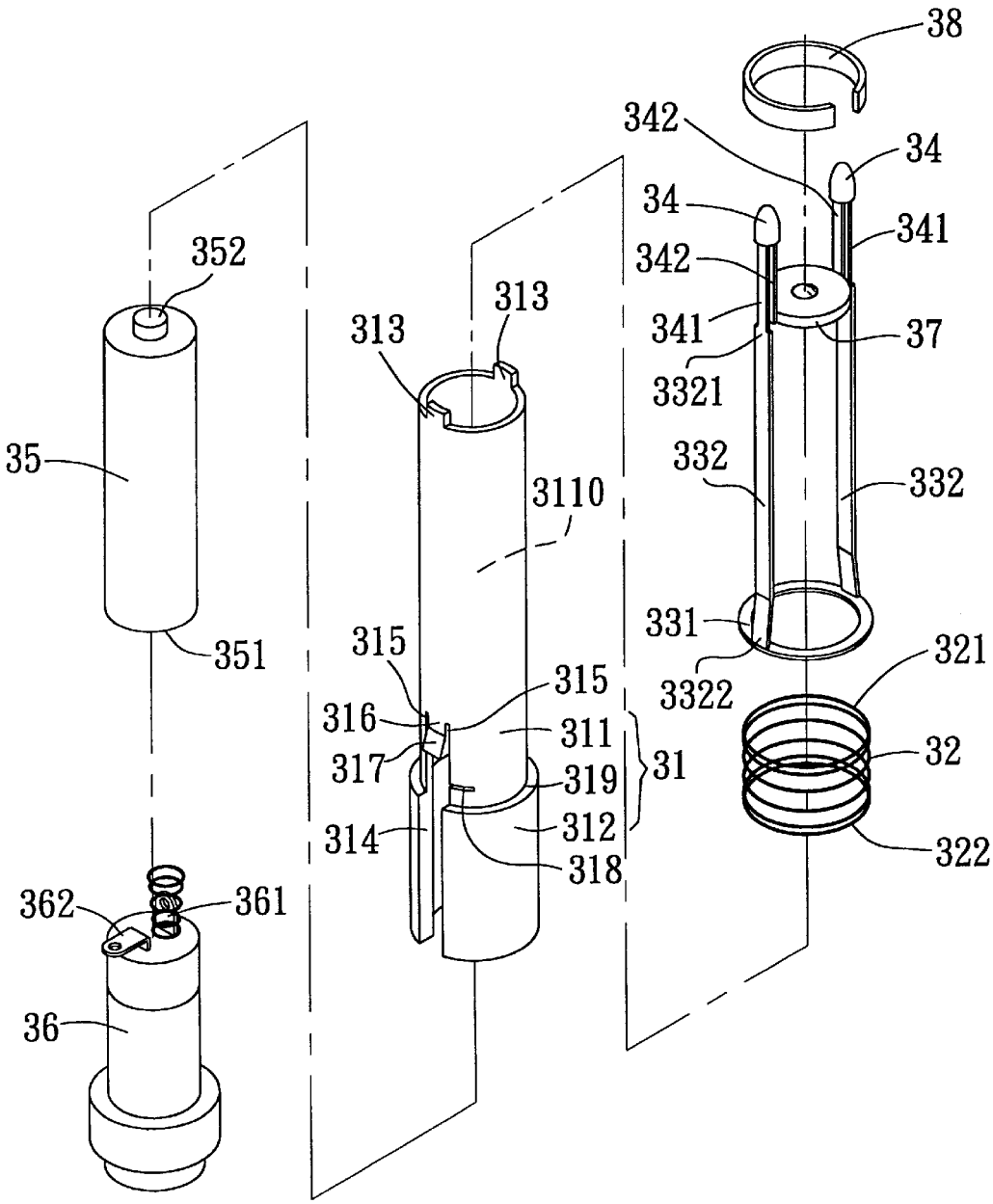
FIG. 3 is an exploded view of a torch of the preferred embodiment.
Figure 4:
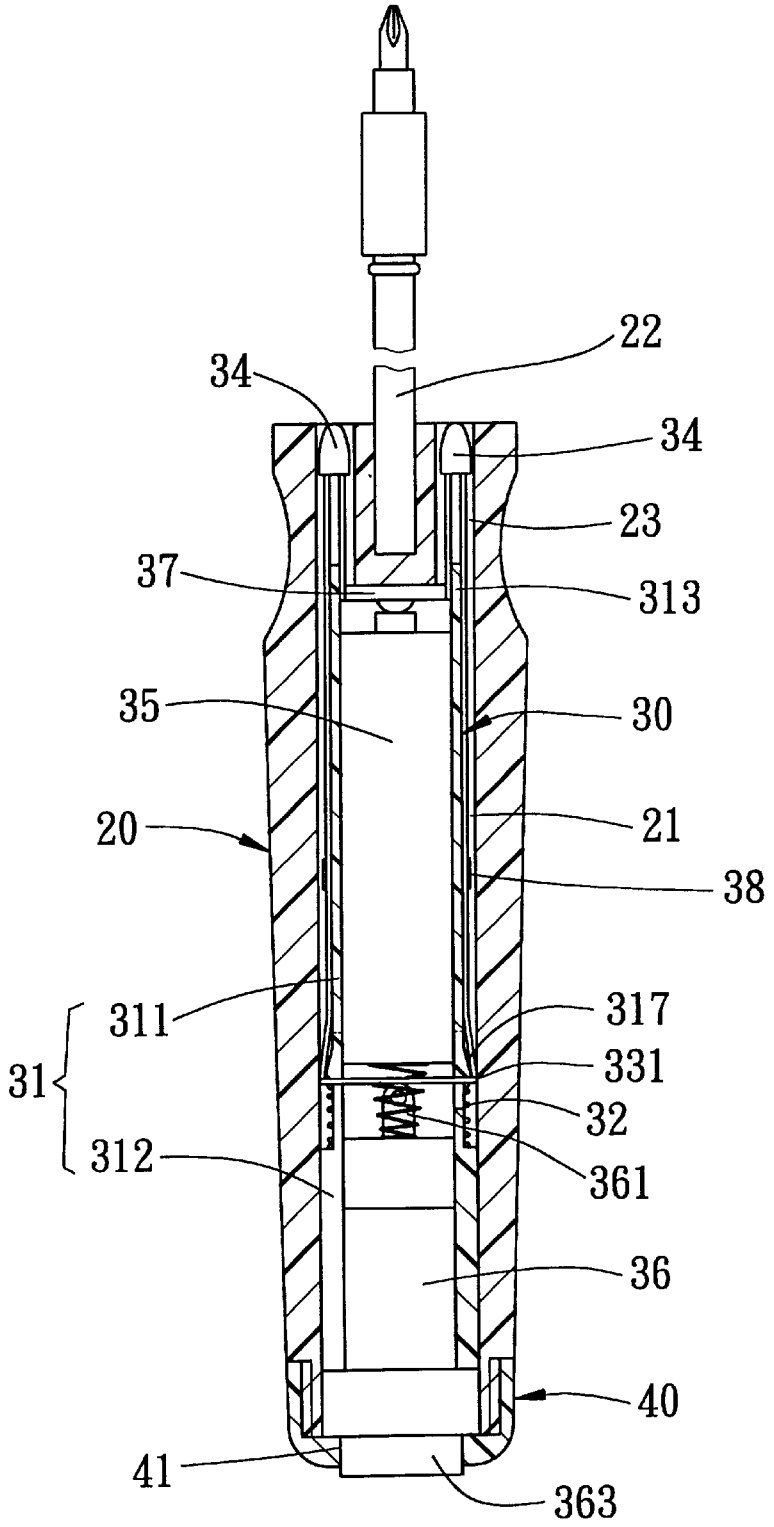
FIG. 4 is a sectional view of the preferred embodiment.

Referring to FIGS. 2, 3 and 4, the driving tool of a preferred embodiment of the present invention is shown to include an elongated hollow handle 20 made from an insulator material, a torch 30, and a rear cap 40 also made from an insulator material.

As illustrated, the handle 20 has a tubular surrounding wall 200 with front and rear ends 201, 202. The surrounding wall 200 extends in a longitudinal direction, and confines a torch receiving compartment 21 therein. A front end wall 203 is disposed at the front end 201 of the surrounding wall 200. The front end wall 203 has a drive shaft 22 that extends therefrom outwardly of the torch receiving compartment 21 in the longitudinal direction. The front end wall 203 is formed with two lamp receiving holes 23 that extend in the longitudinal direction and that are offset from the drive shaft 22. The lamp receiving holes 23 are in communication with the torch receiving compartment 21.

The torch 30 is received removably in the torch receiving compartment 21 via the rear end 202 of the surrounding wall 200 of the handle 20. The torch 30 includes a tubular torch housing 31 made of an insulator material, a switch member 36, two lamps 34, and a circular conductive lamp contact member 37. The torch housing 31 has a front end portion 311 and a rear end portion 312. The front end portion 311 confines a battery receiving space 3110 adapted to receive a battery cell 35 therein.

The switch member 36, preferably a push-button switch member, is mounted in the rear end portion 312 of the torch housing 31, and has a spring-loaded first switch contact 361 adapted to establish electrical contact with a first battery terminal 351 of the battery cell 35 when the latter is received in the battery receiving space 3110, and a second switch contact 362.

The lamps 34 are received in the lamp receiving holes 23 respectively. Each of the lamp 34 has a first lamp terminal 341 that extends into the front end portion 311 of the torch housing 31, and a second lamp terminal 342 electrically insulated from the first lamp terminal 341 and electrically connected to the second switch contact 362 of the switch member 36.

The conductive lamp contact member 37 is disposed in the front end portion 311 of the torch housing 31, and is connected electrically to the first lamp terminals 341 of the lamps 34 at two diametrically opposing positions. The lamp contact member 37 is adapted to establish electrical contact with a second battery terminal 352 of the battery cell 35 when the battery cell 35 is received in the battery receiving space 3110.

The rear cap 40 is mounted threadedly on the rear end 202 of the surrounding wall 200 of the handle 20 for retaining removably the torch 30 in the torch receiving compartment 21. The rear cap 40 is formed with a central opening 41, the purpose of which will be described in the succeeding paragraphs.

In the preferred embodiment, the front end portion 311 of the torch housing 31 is formed with two axially extending positioning projections 313. Each of the positioning projections 313 extends in the longitudinal direction between the first and second lamp terminals 341, 342 of a respective one of the lamps 34 to prevent rotation of the torch housing 30 relative to the tubular surrounding walls 200. The first and second lamp terminals 341, 342 are covered by insulator sleeves. The front end portion 311 of the torch housing 31 has an outer diameter that is smaller than that of the rear end portion 312 thereof, thereby forming a shoulder 319 at a junction of the front and rear end portions 311, 312.

The torch 30 further includes a pair of conductive strips 332, an annular conductive lamp contact piece 331, and a conductive coil spring 32. The conductive strips 332 are disposed on an outer side of the torch housing 31, and extend in the longitudinal direction. Each of the conductive strips 332 has a front end 3321 connected to the second lamp terminal 342 of a respective one of the lamps 34. The conductive lamp contact piece 331 is sleeved on the front end portion 311 of the torch housing 31, and is connected to rear ends 3322 of the conductive strips 332. The conductive coil spring 32 is sleeved on the front end portion 311 of the torch housing 31, and has a front end 321 that abuts against the lamp contact piece 331 and a rear end 322 that is seated on the shoulder 319. The second switch contact 362 is in electrical contact with the coil spring 32.

The torch housing 31 is further formed with an axially extending slot 314 that extends from the rear end portion 312 of the torch housing 31, and a radial slit 318 that opens at one side of the slots 314 such that the switch member 36 can be rotated after insertion into the rear end portion 312 of the torch housing 31 to engage the second switch contact 362 in the slit 318. Under this condition, the second switch contact 362 extends out of said torch housing 31 via the slit 318 for retaining the switch member 36 in the torch housing 31 and for establishing electrical contact with the coil spring 32.

The front end portion 311 of the torch housing 31 is further slitted along two sides 315 of the slot 314 to form a flap 316. The flap 316 is connected to a resilient stop projection 317 that extends radially and outwardly of the torch housing 31. The coil spring 32 biases the lamp contact piece 331 to abut against the stop projection 317. A C-shaped clasp 38 is sleeved on the torch housing 31 for retaining the conductive strips 332 on the outer side of the torch housing 31.

The switch member 36 has a press button 363 that projects outwardly of the rear cap 40 via the central opening 41.

Note that, after removal of the rear cap 40 from the surrounding wall 200, the torch 30 can be taken out from the handle 20 for individual use.

Figure 5:
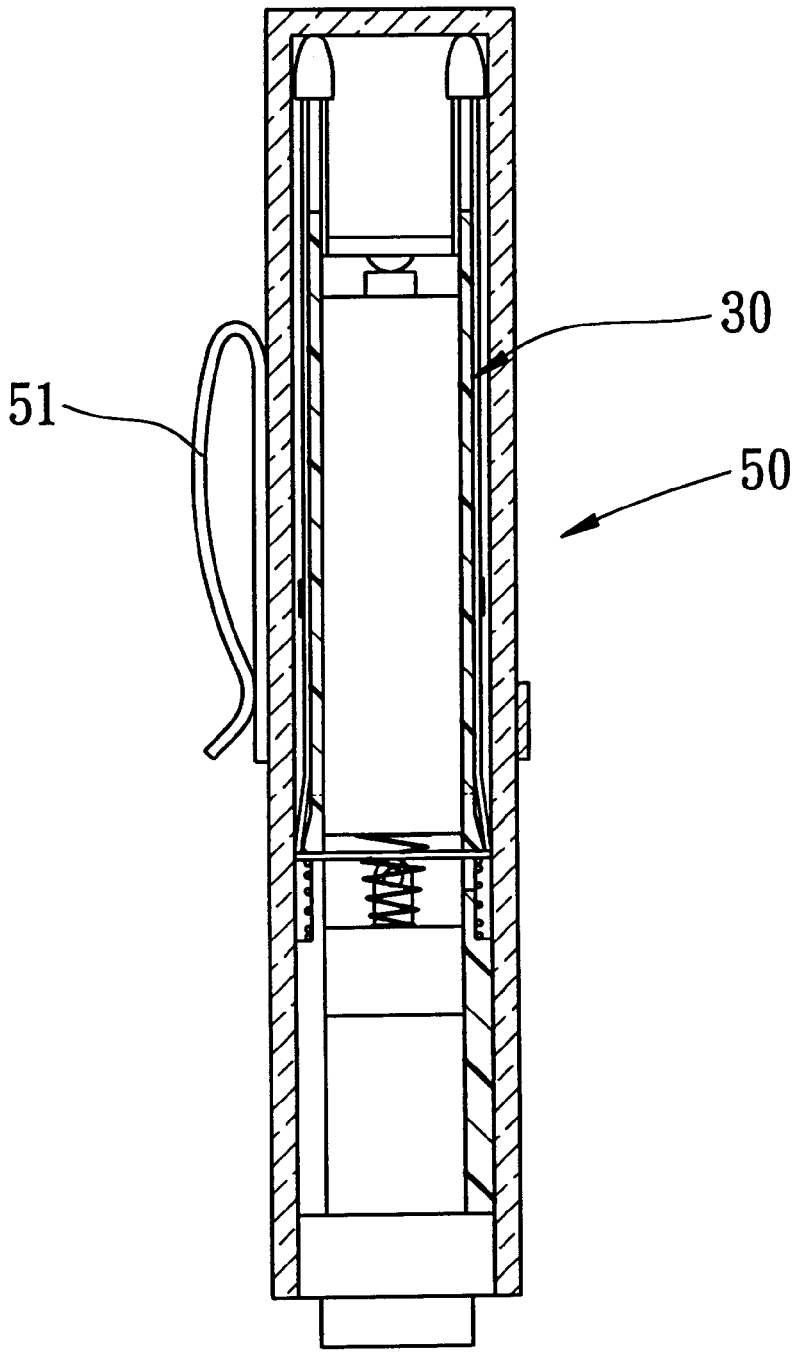
FIG. 5 illustrates how the torch of the preferred embodiment is used in combination with a carrier.

Referring to FIG. 5, the torch 30 employed in the preferred embodiment can be disposed in a transparent tubular casing 50, which is provided with a clip 51 for hanging on a belt of the user.

It has thus been shown that a side from having a simple construction, the driving tool of this invention has a torch that is suitable for individual use. In addition, the battery cell arrangement in this invention does not require two battery cells that are disposed side-by-side, thereby reducing the radial dimension of the handle 20 for ease of operation of the driving tool. The object of the invention is thus met.

With this invention thus explained, it is apparent that numerous modifications and variations can be made without departing from the scope and spirit of this invention. It is, thus, intended that this invention be limited only as indicated in the appended claims.

I claim:

1. A driving tool, comprising:

an elongated hollow handle including:

a tubular surrounding wall with front and rear ends, said surrounding wall extending in a longitudinal direction and defining a torch receiving compartment therein;

a front end wall disposed at said front end of said surrounding wall, said front end wall having a drive shaft that extends therefrom outwardly of said torch receiving compartment in the longitudinal direction, and being formed with a lamp receiving hole that extends in the longitudinal direction and that is offset from said drive shaft; and a torch received removably in said torch receiving compartment via said rear end of said surrounding wall of said handle, said torch including a tubular torch housing having front and rear end portions, said front end portion defining a battery receiving space adapted to receive a battery cell therein, a switch member mounted in said rear end portion of said torch housing, and having a first switch contact adapted to establish electrical contact with a first battery terminal of the battery cell when the battery cell is received in said battery receiving space, and a second switch contact, a lamp extending into said lamp receiving hole and having a first lamp terminal that extends into said front end portion of said torch housing, and a second lamp terminal electrically insulated from said first lamp terminal and electrically connected to said second switch contact, and a conductive lamp contact member disposed in said front end portion of said torch housing and connected electrically to said first lamp terminal of said lamp, said lamp contact member being adapted to establish electrical contact with a second battery terminal of the battery cell when the battery cell is received in said batter receiving space; and a rear cap mounted removably on said rear end of said surrounding wall of said handle for retaining removably said torch in said torch receiving compartment, wherein said torch housing and said handle are formed from an insulator material, wherein said front end portion of said torch housing has an outer diameter that is smaller than that of said rear end portion of said torch housing, thereby forming a shoulder at a junction of said front and rear end portions, wherein said torch further includes:

a conductive strip disposed on an outer side of said torch housing and extending in the longitudinal direction, said conductive strip having a front end connected to said second lamp terminal, and a rear end;

a conductive lamp contact piece sleeved on said front end portion of said torch housing and connected to said rear end of said conductive strip; and a conductive coil spring sleeved on said front end portion of said torch housing and, having a front end that abuts against said lamp contact piece and a rear end that is seated on said shoulder, said second switch contact being in electrical contact with said coil spring; and wherein said torch further includes a C-shaped clasp sleeved on said torch housing for retaining said conductive strip on said outer side of said torch housing.

2. The driving tool as defined in claim 1, wherein said front end portion of said torch housing is formed with a positioning projection that extend between said first and second lamp terminals and into said lamp receiving hole so as to prevent rotation of said torch housing relative to said tubular surrounding wall.

3. The driving tool as claimed in claim 1, wherein said torch housing is formed with an axially extending slot that extends from said rear end portion of said torch housing, and a radial slit that opens at one side of said slot, said second switch contact extending out of said torch housing via said slit for retaining said switch member in said torch housing and for establishing electrical contact with said coil spring.

4. The driving tool as defined in claim 1, wherein said front end portion of said torch housing is formed with a resilient stop projection that extends radially outward, said coil spring biasing said lamp contact piece to abut against said stop projection.

5. The driving tool as defined in claim 1, wherein said switch member is a push-button switch member.

6. The driving tool as defined in claim 1, wherein said first switch contact is a spring-loaded switch contact.

7. The driving tool as defined in claim 1, wherein said rear cap is mounted threadedly on said rear end of said surrounding wall of said handle.

* * * * *